US005216874A

United States Patent [19]

Farrow

[11] Patent Number: 5,216,874

[45] Date of Patent: Jun. 8, 1993

[54] STIRRUP STRAP AND ADJUSTMENT FASTENER

[76] Inventor: Alan W. Farrow, P.O. Box 817, Pagosa Springs, Colo. 81147

[21] Appl. No.: 870,997

[22] Filed: Apr. 20, 1992

[51] Int. Cl.[5] ..... B68C 1/16

[52] U.S. Cl. ..... 54/46.1

[58] Field of Search ..... 54/23, 46.1

[56] References Cited

U.S. PATENT DOCUMENTS 3,096,552 7/1963 Kreger, Jr. ..... 54/46.1 X
4,141,198 2/1979 Gaertner ..... 54/46.1
4,177,623 12/1979 Perry ..... 54/46.1 X
4,233,712 11/1980 Horst et al. ..... 54/46.1 X

*Primary Examiner*—Robert P. Swiatek
*Attorney, Agent, or Firm*—Richard W. Hanes

[57] ABSTRACT

A leather adjustable stirrup strap having a plurality of apertures in a first strap portion and plate-like fastener attached to a second strap portion. The fastener has two inverted U-shaped projections for fitting in selected apertures of the plurality of apertures to form the strap into a closed loop of desired length. A locking strap sized to fit under the U-shaped projections is also provided.

13 Claims, 1 Drawing Sheet

STIRRUP STRAP AND ADJUSTMENT FASTENER

BACKGROUND OF THE INVENTION

The instant invention relates to a stirrup strap and a fastener for allowing adjustment of the length of the strap.

Because horse riders can vary as to their leg length, it is desirable to have the stirrups of a saddle adjustable in distance from the seat of the saddle. In the past, several different methods have been used to achieve adjustment of the stirrups.

U.S. Pat. No. 696,259 to Owens discloses a cinch strap, rather than a stirrup strap, having a series of perforations adapted to receive a stem 14. This is a different construction than Applicant's invention which has a fastener riveted to the stirrup strap and a small locking strap.

A girth buckle is disclosed in U.S. Pat. No. 3,641,739 to Stubben, and U.S. Pat. No. 4,324090 to Nix. The use of buckles on riding equipment is also disclosed by U.S. Pat. No. 745,440 to Horning and U.S. Pat. No. 438,477 to Hartmann. The buckles of these references are different than Applicant's fastener which uses a locking leather strap. Also, these references do not disclose an adjustable stirrup strap.

A stirrup adjusting and locking device is disclosed in U.S. Pat. No. 4,413,465. The locking device disclosed is much more complicated than Applicant's stirrup strap and fastener.

A fastener for a stirrup strap is shown in U.S. Pat. No. 4,177,623 to Perry. The fastener has prongs 22 and 24 which fit into holes in the strap. A projection 26 seeks to prevent accidental removal of the prongs from the selected holes. A locking mechanism or strap as Applicant provides is not disclosed. Accidental removal of the fastener of Perry would seem more likely with leather wear and the passage of time.

U.S. Pat. No. 4,233,712 to Horst discloses a stirrup buckle including a locking slide 30. Such an arrangement is more complex than Applicant's locking strap.

A junior stirrups attachment for an adult sized saddle is shown in Christensen, U.S. Pat. No. 4,164,834. The patent does disclose a locking thong 10, which is secured differently than Applicant's invention. The thong 10 must be passed through three holes 9 in the strap and then fed back under itself to be secure. This can be quite a clumsy and time-consuming procedure.

It is an object of the instant invention to provide an adjustable stirrup strap and fastener which can be quickly and securely adjusted to the desired length.

It is also an object of the instant invention to provide a fastener for a stirrup strap which can be inexpensively manufactured without an expensive and complicated locking mechanism.

SUMMARY OF THE INVENTION

An adjustable stirrup strap is formed of flexible leather. A plate-like fastener is attached to one end of said strap. Two inverted U-shaped projections are disposed on one side of the plate-like portion and the end of a locking strap is riveted to the other side thereof. The leather stirrup strap includes a plurality of apertures therein. To form the stirrup strap into a looped configuration, the two inverted U-shaped projections are placed through apertures in the stirrup strap. The locking strap is then fitted through another aperture in the stirrup strap and then passed under the U-shaped portions to secure the leather stirrup strap in a looped configuration. The length of the looped stirrup strap can be varied depending on the apertures selected.

DESCRIPTION OF THE PREFERRED EMBODIMENT

Figure 1:
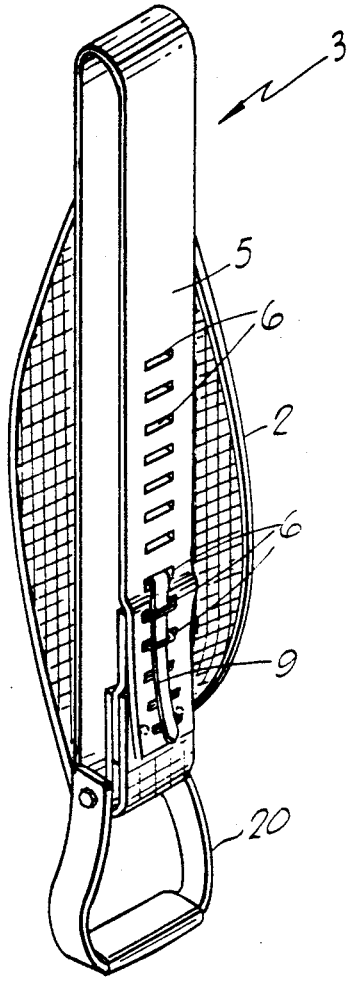
FIG. 1 is a perspective view showing the stirrup strap in its looped closed position.

A looped adjustable stirrup strap 3 is shown in FIG. 1. The strap 3 is formed of a flexible elongated length of material such as leather and includes apertures 6 on strap portion 5 for adjusting the position of stirrup 20 which is supported by the strap 3. In the preferred embodiment, the strap is backed by a fender 2 layered therewith as is well known. The strap 3 and fender 2 are preferably formed of leather although other flexible materials could be used.

Figure 2:
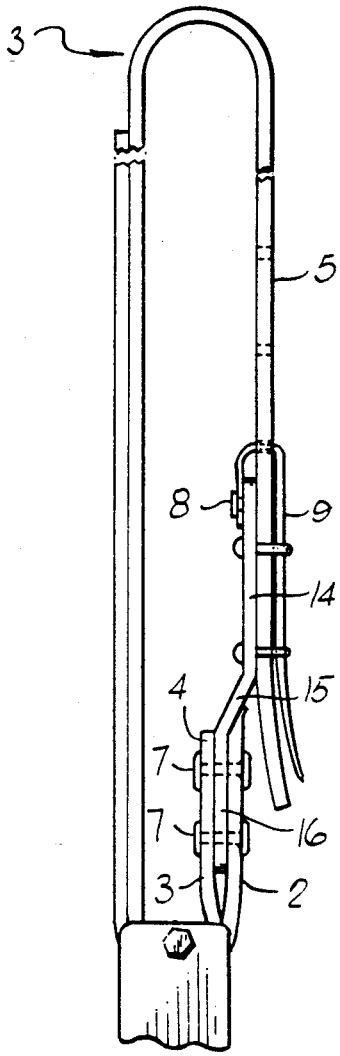
FIG. 2 is a side view of the configuration of FIG. 1.
Figure 3:
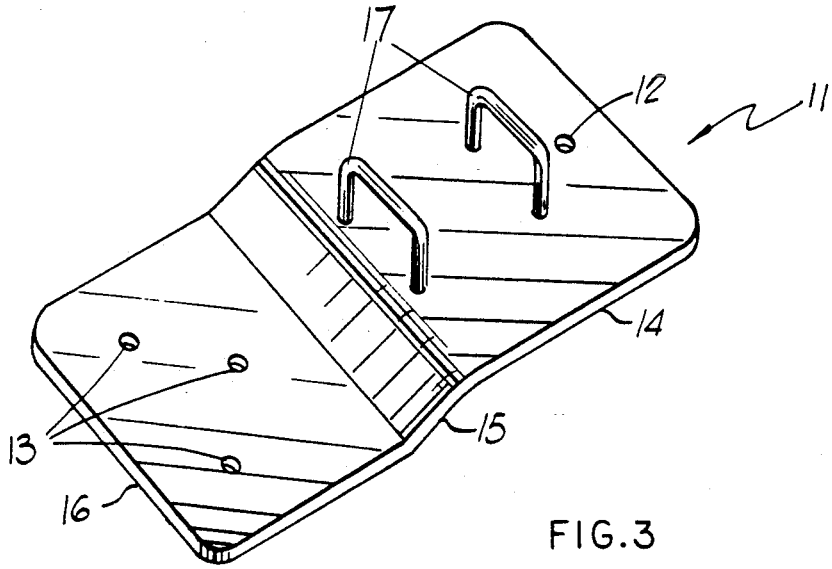
FIG. 3 is an enlarged detail view of the plate-like fastener.

The novel adjustment of the stirrup strap is now described with reference to FIGS. 1–3. Fastener plate 11 formed of suitable rigid material such as well known metal or plastic is shown in detail in FIG. 3. The plate 11 includes portion 14 to which inverted U-shaped projections or staples 17 are permanently attached. Sloped portion 15 offsets plate portion 14 from plate portion 16. This allows for overlap of the strap 5 in the looped closed position as shown in FIG. 2. Plate portion 16 is riveted between strap 3 and an extension of the fender 2 by rivets 7 which are placed through predrilled holes 13, although other well known attachment methods could be used.

A locking strap 9 is provided to secure the stirrup strap 3 at its desired length. The strap 9 is preferably formed of leather, although other well known flexible material could be used. The strap 9 is riveted to plate portion 14 by rivet 8 through a predrilled hole 12 in the plate portion 14. Other well known methods of attachment could also be used for the rivet.

The operation and adjustment of the stirrup strap 3 will now be described. After stirrup 20 is slipped on strap 3, the end portion 4 of strap 3 is lifted to raise the stirrup 20 to the desired location. It is noted that strap 3 has been attached to the saddle by well known means such as looping through a ring or slot on the main saddle portion (not shown).

When the stirrup 20 reaches the desired height, staples or projections 17 are placed in adjacent apertures 6 on the strap portion 5 of the stirrup strap 3. The apertures 6, through which the staples 17 are placed, correspond to the desired location of the stirrup.

To secure the stirrup in place, strap 9 is passed through an aperture on strap portion 5 that lies above plate 11 and then down under the inverted U-shaped staples 17 as shown in FIGS. 1 and 2. Although the figures illustrate the strap 9 being passed through an aperture 6 directly above the apertures receiving the projections or staples 17, it is noted that any aperture 6 above the plate could be used so long as strap 9 was of sufficient length to still be secured under staples or projections 17.

The adjustment mechanism for only one stirrup of the saddle is described. It is understood that the other stirrup can be similarly adjusted individually to suit the rider's leg length. The use of the locking strap assures the stirrup strap against slippage in length and secures it in the desired position.

It is also noted that U-shaped projections or staples 17 can be of any shape or configuration so long as they allow the locking strap to be secured. Thus, other modifications would be obvious to one of ordinary skill in the art. Also, although two projections or staples 17 are illustrated, other numbers of projections could be used.

It is noted that various modifications may be made without departing from the scope of the invention as it is defined in the following claims.

I claim:

1. An adjustable stirrup strap comprising, a flexible strap of material having a first strap portion and a second strap portion, a plurality of apertures in said first strap portion, a fastener means attached to said second strap portion, means for attaching said first strap portion to said second strap portion to form a looped stirrup strap, said means for attaching comprising at least one projection on said fastener means sized to fit through a selected one of said plurality of apertures on said first strap, and a locking strap affixed to said fastener means and sized to fit through another of said plurality of apertures.

2. The adjustable stirrup strap of claim 1 wherein said at least one projection is sized to fit alternatively through another selected aperture of said plurality of apertures and wherein the length of said looped stirrup strap is adjusted depending on the aperture selected.

3. The adjustable stirrup strap of claim 1 further comprising a fender portion and wherein said fastener means is attached to said second strap portion and said fender portion.

4. The adjustable stirrup strap of claim 1 wherein said material is formed of leather.

5. The adjustable stirrup strap of claim 1 wherein said means for attaching further comprises two projections on said fastener means and said projections being spaced from each other to fit through adjacent apertures of said plurality of apertures.

6. The adjustable stirrup strap of claim 5 wherein said projections are in an inverted U-shape.

7. The adjustable stirrup strap of claim 6 wherein said locking strap is sized to fit under the inverted U-shape of said projections.

8. The adjustable stirrup strap of claim 1 wherein said locking strap is riveted to said fastener means.

9. The adjustable stirrup strap of claim 1 wherein said fastener means is riveted to said fender and said second strap portion.

10. A fastener for attaching the ends of an elongated strap of material used on a saddle to form such material into a loop comprising:

a plate, at least one inverted U-shaped projection on said plate, a locking strap attached to said plate, said locking strap sized to fit under said at least one inverted U-shaped projection so that when said plate is attached to one portion of such strap said locking strap will fit through a selected aperture in another portion of such strap and under said at least one U-shaped projection to secure such strap of material into a loop.

11. The fastener of claim 10 wherein said plate comprises a first plate portion, said locking strap and at least one projection being attached to said first plate portion and a second plate portion for attachment to such strap material.

12. The fastener of claim 11 and further comprising a third sloped plate portion between said first and second plate portions.

13. The fastener of claim 10 comprising two inverted U-shaped projections on said plate.

* * * * *